US005491908A

United States Patent [19]

Ruiz et al.

[11] Patent Number: 5,491,908

[45] Date of Patent: Feb. 20, 1996

[54] DRYING DEVICE

[76] Inventors: Fidel A. Ruiz; Anna C. Ruiz, both of 337 First St., Box 20449, Calexico, Calif. 92231

[21] Appl. No.: 291,762

[22] Filed: Aug. 17, 1994

[51] Int. Cl.[6] ..... F26B 19/00

[52] U.S. Cl. ..... 34/202; 34/90; 34/91; 392/383

[58] Field of Search ..... 34/90, 91, 202; 392/383

[56] References Cited

U.S. PATENT DOCUMENTS 5,280,679 1/1994 Edelman ..... 34/66

*Primary Examiner*—Henry A. Bennett
*Assistant Examiner*—Siddharth Ohri
*Attorney, Agent, or Firm*—Juettner Pyle Lloyd & Piontek

[57] ABSTRACT

A device for drying the feet of invalids and physically challenged persons includes a foot support surface upon which a person may step without significant vertical transition from the surrounding floor surface. A plenum chamber is disposed adjacent to a distal and two lateral side edges of the foot support surface. Airflow means provides a flow of heated air to the plenum chamber. The airflow is directed through openings in corresponding distal and lateral walls of the plenum chamber toward the user's foot or feet in a path along and substantially parallel to the foot support surface. Foot operated control means allow the user to control the airflow to the distal, proximal, lateral and medial regions of the foot to dry the same.

10 Claims, 2 Drawing Sheets

DRYING DEVICE

FIELD OF THE INVENTION

The present invention relates to an improved drying device for human feet, and in particular, a device comprised of a foot support surface and airflow means for directing an airflow substantially parallel to the foot support means and toward the user's feet.

BACKGROUND OF THE INVENTION

Most persons find it desirable and healthful to bath on a regular basis. For some individuals, however, problems are encountered when attempting to dry various portions of their bodies after bathing. These problems are especially true with respect to invalids, the elderly and other physically challenged persons, where personal mobility is often restricted. Those portions of their bodies creating the greatest challenges are often the feet.

The inability to adequately dry one's feet often creates adverse health consequences beyond the consequences of discomfort. For example, various fungal infestations tend to thrive in the presence of moisture, and are often encouraged by the lack of proper drying of the feet. Thus, the inability of many persons to adequately dry their feet is of considerable importance.

Devices for drying or removing moisture after bathing have long been available. Indeed, the use, for example, of heated air hand dryers in public rest rooms has greatly contributed to sanitation and maintenance benefits. Such devices, however, are inappropriate for drying portions of the human body other than the hands.

Other devices developed for drying other body portions exist. One such device is shown in U.S. Pat. No. 3,711,958 to Lepage, which discloses a body towel device for overall body drying. However, no foot drying feature is disclosed or suggested.

Devices for drying articles of clothing, such as footwear, and exist, but are undesirable toward the objectives of the present invention for one or more reasons. For example, U.S. Pat. No. 4,677,764 to Cerny discloses a device having a planar surface on which wet articles of clothing may be placed. Air is directed upwardly through openings in the planar surface to accelerate the drying process. This patent does not disclose or suggest application to drying feet.

U.S. Pat. No. 5,187,850 to Terng-Shuh contemplates a foot sole drying device, wherein a pair of air dryers generate an air current upwardly through a wire mesh to the user's feet and legs. However, no disclosure or suggestion is made of a device upon which an individual may conventionally and safely stand.

U.S. Pat. No. 5,007,182 to Fishman et al. discloses a body drier having a raised platform upon which a person may stand and through which heated air is upwardly directed through apertures. However, due to the raised platform necessitated by the upwardly drafted fan, the step-up device may not be appropriate for those persons most in need of assisted foot drying.

Moreover, the latter three devices all provide an upwardly directed airflow, that is, toward the sole of the user's foot. Thus, a large portion of the airflow passes by the user's foot and performs no useful function. Further, the upper regions of the foot are not effectively within the airflow path and thus remain wet even after the drying process.

SUMMARY OF THE INVENTION

The objects of the present invention are to: provide an effective and efficient device overcoming the deficiencies of the prior art; allow ready use by invalids and other physically challenged persons for drying their feet; direct an airflow toward the feet in a generally horizontal plane encircling the user's feet within the horizontal plane; provide a structure upon which a person may stand and which may be accessed from a horizontal level substantially the same as that of the surrounding floor surface; and allow remote operation without requiring the user to bend over.

The foot laying device of the invention emphasizes a non-skid foot support surface leaving little or no vertical transition from the surrounding floor surface. Three side edges of the support surface are disposed adjacent a plenum. Heated air is directed through openings in the walls of the plenum toward the user's foot or feet in a path slightly above and substantially parallel to the plane of the foot support surface. Control means, preferentially located so as to be foot-operated, allow the user to control the airflow, to direct heated air onto the distal, proximal, lateral and medial regions of the foot, as well as the upper portions of the foot and ankle.

The foot support surface preferably inclined relative to the horizontal to allow the run-off of excess water and may include a water collection reservoir for the run-off. Various sizes of openings may be used in the side walls of the plenum chamber to direct airflow preferentially to the lateral and medial portions of the foot. The plenum chamber is assembled from two U-shaped channel portions, one upwardly open and the other one downwardly open.

The invention thus provides significant advantages and achievements over the prior art. Additional objects and advantages will become apparent from the following detailed description, as considered in connection with the accompanying drawings.

DETAILED DESCRIPTION OF THE PREFERRED EMBODIMENTS

The following is a description of the best mode presently contemplated by the inventor for carrying out the invention. Other modes of carrying out the invention, without departing from the scope of the invention, will become apparent to those skilled in the art as the description proceeds.

Figure 1:
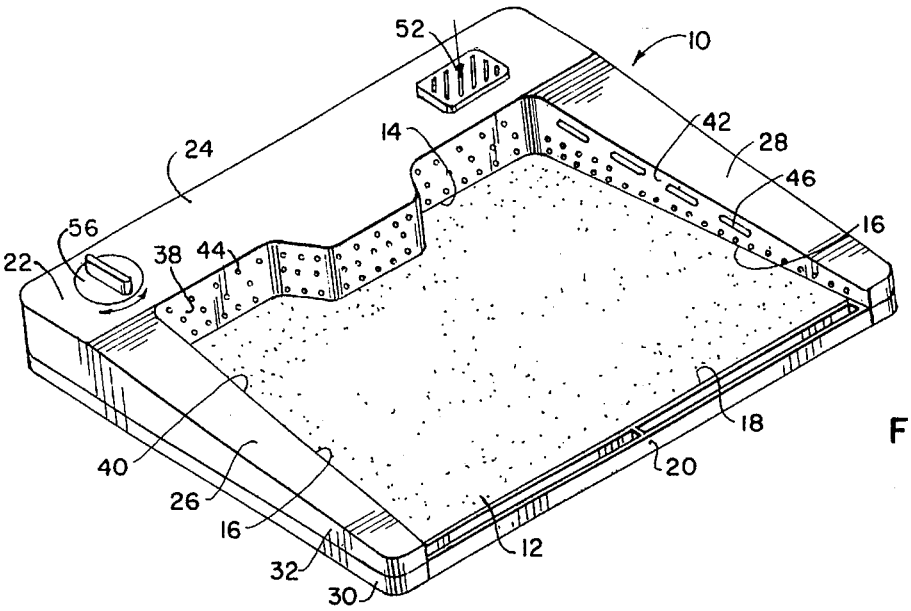
FIG. 1 is a perspective view of the preferred embodiment of the foot drying device of the present invention.

Referring to FIG. 1 of the drawings, the foot drying device 10 of the invention comprises a base portion including a foot support surface or platform 12, only slighted raised in elevation from the surrounding floor surface (e.g., one half inch), upon which a person may stand or otherwise place his/her feet. The foot support surface 12 is preferably provided with a toughened or other non-skid finish and its perimeters are substantially defined by a rear or distal edge 14 and two side edges 16. An open front or proximal edge 18, is positioned adjacent a water collection trough 20. The foot support surface 12 is preferably slightly inclined (i.e., 0.5 to 1.0 degrees) from horizontal, such that any water deposited thereon will run off the foot support surface 12 for collection in the water trough 20. The trough is preferably removable from the device 10 for disposal of any water which may run off the foot support surface 12.

Figure 2:
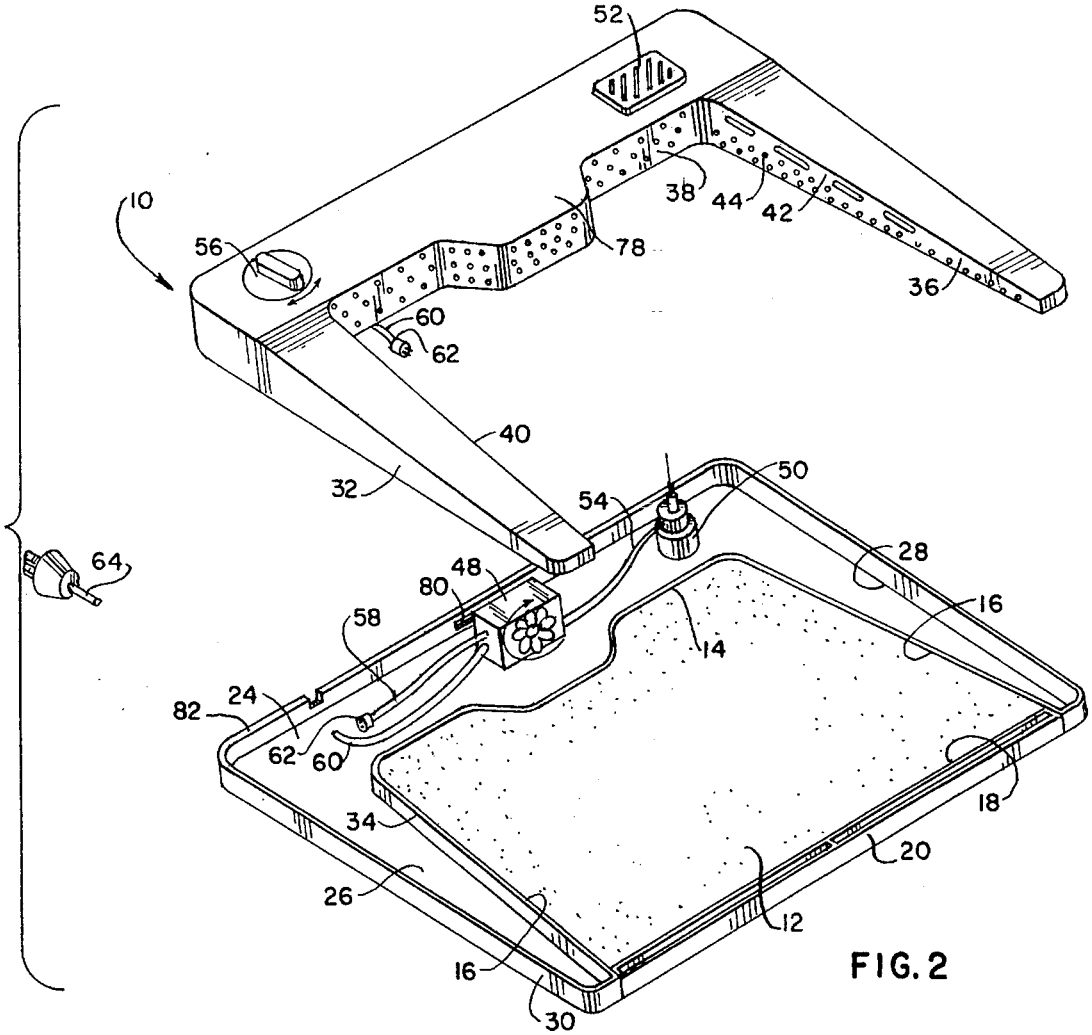
FIG. 2 is a perspective exploded view of the preferred embodiment of the device.

As further shown in FIGS. 1 and 2, a plenum chamber 22 is positioned adjacent the rear edge 14 and side edges 16 of the foot support surface 12. The plenum chamber 22 is comprised of a distal chamber 24 and two opposite lateral chambers 26, 28. The plenum chamber 22 is preferably constructed from two interfitting molded plastic chamber members 30, 32, which can be made of any durable and readily formable plastic material, as can the foot support surface or base 12. A sealing means (not shown) can be placed between the chamber members 30, 32 when joined to provide a substantially airtight seal.

The chamber member 30 is an upwardly open lower chamber member, as best seen in FIG. 2. The lower chamber member 30 may be molded integrally with the foot support 12, or the two may be formed respectively and assembled in any suitable manner, such as interlocking tabs and notches (not shown).

The chamber member 32 is a downwardly open upper chamber member, likewise best shown in FIG. 2. The upper chamber member 32 is provided with an inner peripheral wall 36, which includes a distal wall 38 and two lateral walls 40, 42. Each of the walls 38, 40, and 42 are provided with air outlet orifices or apertures 44, and the lateral walls 40, 42 are also provided with air outlet slots or orifices 46 arranged along their respective lengths. The function of the orifices 44, 46 will be discussed below.

Figure 4:
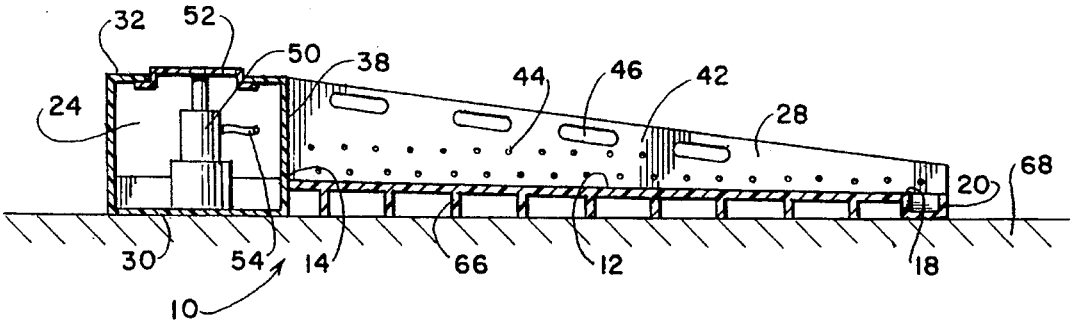
FIG. 4 is a sectional side view of the preferred embodiment of the device taken along the line 4–4 of FIG. 3.

As shown in FIGS. 2 and 4, the internal components of the device 10 preferably include a combined airflow and heating element (or heating fan) 48. A pressure switch 50 is operatively disposed below a foot switch plate 52 and is electrically connected to the heating fan 48 through leads 54. Likewise, a temperature control switch 56 is preferably provided in an accessible position, such as on an upper surface of the distal chamber 24. The temperature control switch 56 may be electrically connected to the heating fan 48 through leads 58, 60 and connector assembly 62. Power for the device 10 may be provided through power supply line 64, which terminates in a conventional wall outlet plug for 100V devices.

The device 10 of the present invention is suited for supporting a person standing thereon or supporting the feet of a person seated in an adjoining chair. The foot support surface 12 is itself supported from below, preferably by a series of reinforcing ribs 66 provided on the lower surface thereof, as best shown in FIG. 4. Thus, when a person is standing on the foot support surface 12, the load is directly transmitted to the overall floor surface 68, preventing undue load or stress on the plenum chamber 22.

Figure 3:
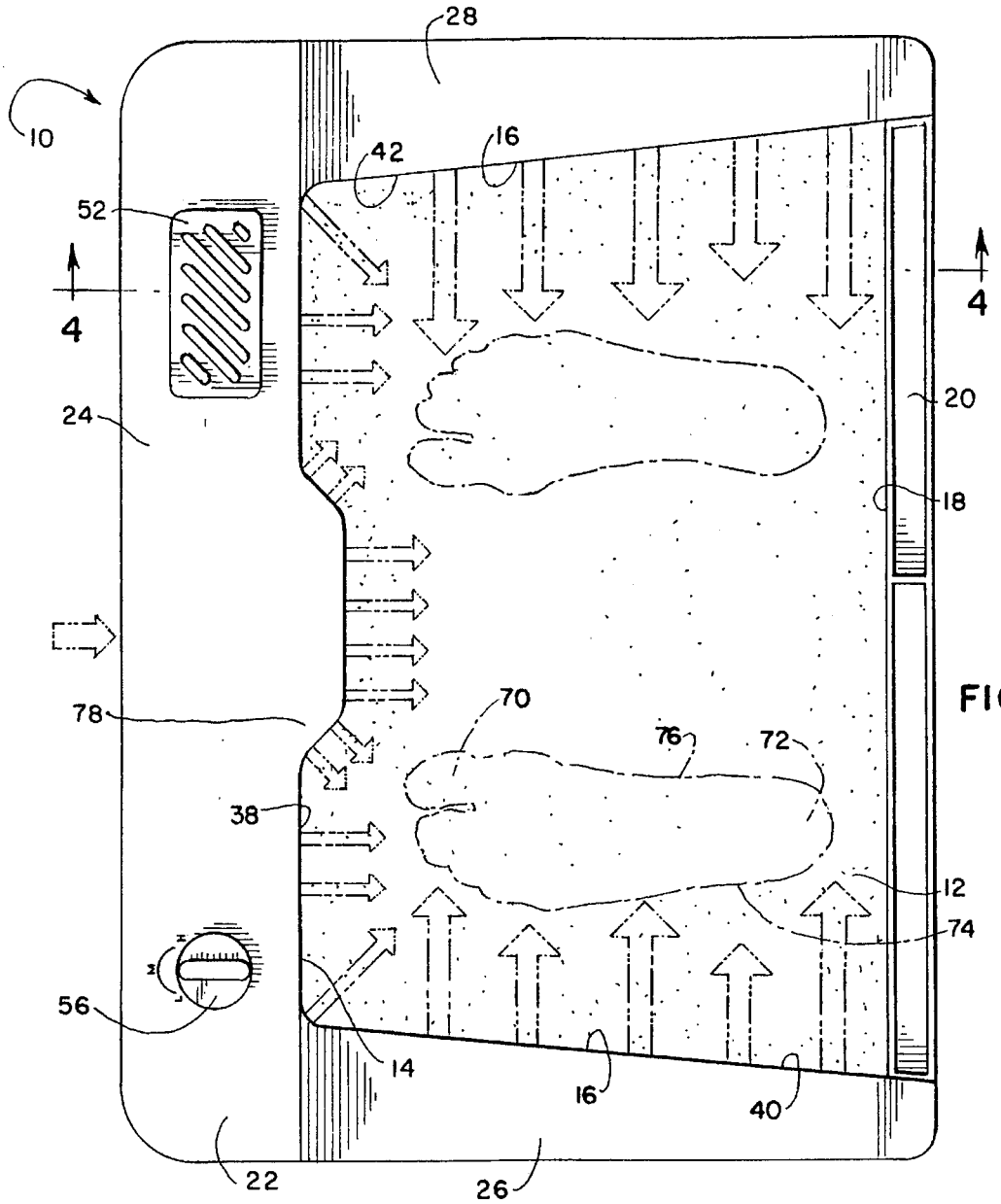
FIG. 3 is a top plan view of the preferred embodiment of the device.

In operation, users need merely place their feet on the foot support structure 12, either standing or sitting in a nearby chair. In either case, no substantial vertical movement is required. The user's feet, having a distal portion 70, proximal portion 72, lateral portion 74, and medial portion 76, are readily accepted on the foot support structure 12 and within the device 10, as depicted in FIG. 3. When the user's feet are properly positioned, the user is required only to raise one foot slightly and lightly tap the foot switch plate 52 to actuate the device 10. Upon actuation, air is drawn into the plenum chamber 22 through air inlet slots 80 positioned on a rear wall 82 of the distal plenum chamber 24. The temperature control switch 56 may be further manipulated as needed to alter the airflow temperature.

As further shown in FIG. 3, airflow from the heating fan 48 is directed through and from the distal and lateral plenum chambers 24, 26 and 28 toward the user's feet in at least three different directions. Moreover, owing to the greater individual and aggregate area of the orifices 44 and 46 on and through the lateral walls 40, 42 relative to the orifices 44 on and through the distal wall 38, a proportionally increased airflow is preferentially directed to the lateral portions 74 of the user's feet. As is apparent from FIG. 3, the laterally directed airflow is preferentially directed in substantially equal flow rates from both lateral walls 26, 28.

A further refinement of the present invention lies in the addition of a projecting chamber 78 located centrally of the distal wall 38 of the chamber 24. The projecting chamber 78 thereby defines an airflow dispersing projection for directing a portion of the airflow from the distal wall 38 obliquely relative the distal and lateral walls 38, 40 and 42 toward the user's feet, thereby promoting drying in the user's foot distal portion 70, especially the user's toes.

The objects and advantages of the invention have been shown to be attained in an economical, practical and facile manner. To wit, invalids and other physically impaired individuals may now avail themselves of a readily accessible device which completely and effectively dries feet without complicated manual manipulations from a standing or a sitting position.

While a preferred embodiment of the invention has been herein illustrated and described, it is to be appreciated that various changes, rearrangements and modifications may be made therein, without departing from the scope of the invention as defined by the appended claims.

What is claimed is:

1. A foot drying device adapted to be supported on a floor surface defining a floor plane, comprising:

a base having a foot support surface adapted to accept and support a human foot, the foot support surface comprising a distal and two lateral side edges and being in a plane coincident with the floor plane;

airflow means;

a plenum chamber for receiving air from the airflow means and situated relative the foot support surface to direct toward the foot airflow from the distal and lateral side edges of and in a plane parallel to the plane of the foot support surface, the plenum chamber having a distal wall and two lateral walls adjacent the distal and lateral edges of the foot support surface, each of the plenum chamber walls having openings therethrough for directing airflow toward the foot along and parallel to the plane of the foot support surface, the openings through the lateral walls of the plenum chamber including openings of larger individual and aggregate area than the openings through the distal wall of the plenum chamber such that the airflow to the foot is preferentially directed in greater proportion toward the sides of the foot; and control means for regulating the airflow means.

2. A foot drying device adapted to be supported on a floor surface defining a floor plane, comprising:

a base having a foot support surface adapted to accept and support a human foot, the foot support surface comprising a distal and two lateral side edges and being in a plane coincident with the floor plane;

airflow means;

a plenum chamber for receiving air from the airflow means and situated relative the foot support surface to direct toward the foot airflow from the distal and lateral side edges of and in a plane parallel to the plane of the foot support surface; and control means for regulating the airflow means comprising a foot actuated switch adjacent to the foot support surface.

3. A foot drying device adapted to be supported on a floor surface defining a floor plane, comprising:

a base having a foot support surface adapted to accept and support a human foot, the foot support surface comprising a distal and two lateral side edges and being in a plane coincident with the floor plane;

airflow means including an air heating element and control means therefor, the air heating element control means being disposed on a exposed, accessible portion of the device for operation by the user;

a plenum chamber for receiving air from the airflow means and situated relative the foot support surface to direct toward the foot airflow from the distal and lateral side edges of and in a plane parallel to the plane of the foot support surface; and control means for regulating the airflow means.

4. A foot drying device adapted to be supported on a floor surface defining a floor plane, comprising:

a base having a foot support surface adapted to accept and support a human foot, the foot support surface comprising a distal and two lateral side edges and being in a plane coincident with the floor plane, the foot support surface having an open front edge and the foot support surface being inclined relative to the floor plane such that the distal edge is higher than the front edge;

airflow means;

a plenum chamber for receiving air from the airflow means and situated relative the foot support surface to direct toward the foot airflow from the distal and lateral side edges of and in a plane parallel to the plane of the foot support surface; and control means for regulating the airflow means.

5. The device of claim 4 including a water collection trough adjacent the open front edge of the foot support surface for receiving water draining from the surface.

6. A foot drying device adapted to be supported on a floor surface defining a floor plane, comprising:

a base having a foot support surface adapted to accept and support a human foot, the foot support surface comprising a distal and two lateral side edges and being in a plane coincident with the floor plane;

airflow means;

a plenum chamber for receiving air from the airflow means and situated relative the foot support surface to direct toward the foot airflow from the distal and lateral side edges of and in a plane parallel to the plane of the foot support surface, the plenum being comprised of an upwardly open U-shaped channel and a downwardly open U-shaped channel, each disposed about the distal and lateral side edges of the foot support surface, the upwardly open and downwardly open U-shaped channels interfittingly engaging each other so as to form art airtight plenum chamber and a distal and two lateral walls extending upwardly relative to the foot support surface; and control means for regulating the airflow means.

7. The device of claim 6, wherein the distal and lateral walls of the plenum chamber have a plurality of openings therethrough for directing airflow toward the user's foot along and parallel to the foot support surface.

8. The device of claim 7, wherein the openings through the lateral walls of the plenum chamber are of larger individual and aggregate area than the openings through the distal wall of the plenum such that airflow to the foot is preferentially directed through each of the lateral walls in equal flow rates.

9. A foot drying device adapted to be supported on a floor surface defining a floor plane, comprising:

a base having a foot support surface adapted to accept and support a human foot, the foot support surface comprising a distal and two lateral side edges and being in a plane coincident with the floor plane, the distal wall of the plenum chamber including an airflow dispersing projection disposed equidistantly from each of the lateral walls of the plenum chamber for directing a portion of the airflow from the distal wall obliquely relative to the distal and lateral walls;

airflow means airflow means housed within the plenum chamber, the airflow means comprising an electric motor, a fan for regulating the airflow, a heating element and a heating element control switch for regulating the temperature of the airflow;

a plenum chamber for receiving air from the airflow means and situated relative the foot support surface to direct toward the foot airflow from the distal and lateral side edges of and in a plane parallel to the plane of the foot support surface; and control means for regulating the airflow means.

10. A foot drying device comprising:

a base supported on a surface defining a floor plane;

the base having a non-skid foot support surface adapted to accept and support a human foot, the foot support surface having a distal and two lateral side edges and being supported in a plane coincident with the floor plane and having an open front edge, the foot support surface being inclined relative to the floor plane such that the distal edge is higher than the front edge;

a water collection trough adjacent the open front edge of the foot support surface for receiving water collection draining from the surface;

an upwardly open U-shaped channel and a downwardly open U-shaped channel each disposed about the distal and two lateral edges of the foot support surface, the upwardly open and downwardly open U-shaped channels interfittingly with each other to form an airflow plenum chamber having a distal and two lateral walls extending upwardly relative to and adjacent the foot support surface distal and lateral edges;

airflow means mounted in the plenum for forcing air therethrough;

a plurality of openings through the distal and lateral walls of the plenum chamber directing airflow toward the foot along and parallel to the foot support surface;

the openings through the lateral walls of the plenum chamber being of larger individual and aggregate area than the openings through the distal wall of the plenum chamber such that airflow is preferentially directed in greater proportion through the openings through the lateral walls in equal flow rates through each of the lateral walls; and foot actuated control means for regulating the airflow contiguous to the foot support surface.

* * * * *